US010676852B2

(12) United States Patent
Pollett et al.

(10) Patent No.: US 10,676,852 B2
(45) Date of Patent: Jun. 9, 2020

(54) TUB FOR A WASHING MACHINE APPLIANCE

(71) Applicant: Haier US Appliance Solutions, Inc., Wilmington, DE (US)

(72) Inventors: James Quentin Pollett, Louisville, KY (US); S. Neil Malone, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 452 days.

(21) Appl. No.: 15/798,577

(22) Filed: Oct. 31, 2017

(65) Prior Publication Data

US 2019/0127902 A1 May 2, 2019

(51) Int. Cl.

| | |
|---|---|
| ***D06F 37/26*** | (2006.01) |
| ***D06F 37/06*** | (2006.01) |
| ***D06F 37/30*** | (2020.01) |
| ***D06F 39/14*** | (2006.01) |
| ***D06F 39/08*** | (2006.01) |
| ***D06F 39/02*** | (2006.01) |
| ***D06F 33/00*** | (2020.01) |
| ***D06F 34/28*** | (2020.01) |

(52) U.S. Cl.

CPC ..... *D06F 37/264* (2013.01); *D06F 33/00* (2013.01); *D06F 34/28* (2020.02); *D06F 37/06* (2013.01); *D06F 37/304* (2013.01); *D06F 39/02* (2013.01); *D06F 39/085* (2013.01); *D06F 39/088* (2013.01); *D06F 39/14* (2013.01); *D06F 37/262* (2013.01); *D06F 37/263* (2013.01)

(58) Field of Classification Search

None

See application file for complete search history.

(56) References Cited

U.S. PATENT DOCUMENTS

| | | | |
|---|---|---|---|
| 3,603,118 | A | 9/1971 | Brucken et al. |
| 2005/0204559 | A1 | 9/2005 | Hartwig et al. |

FOREIGN PATENT DOCUMENTS

| | | | |
|---|---|---|---|
| EP | 1568812 | A2 | 8/2005 |
| EP | 1505188 | B1 | 9/2005 |
| KR | 100987434 | B1 | 10/2010 |

*Primary Examiner* — Rita P Adhlakha

(74) *Attorney, Agent, or Firm* — Dority & Manning, P.A.

(57) ABSTRACT

A tub assembly for a washing machine appliance includes a tub and a wash basket rotatably mounted within the tub. The tub defines a central axis extending along an axial direction, a radial direction perpendicular to the central axis, and a circumferential direction extending around the central axis. The tub comprises a first material. The wash basket defines a wash chamber for receiving articles for washing. A reinforcement band encircles the tub generally along the circumferential direction. The reinforcement band comprises a second material having a greater strength than the first material of the tub.

20 Claims, 7 Drawing Sheets

TUB FOR A WASHING MACHINE APPLIANCE

FIELD OF THE INVENTION

The present subject matter relates generally to washing machine appliances and more specifically to a washing machine having a stationary outer tub with reinforcing features.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

The tub of the washing machine appliance is usually constructed of a lightweight material, e.g., plastic, which is suitable for use in a wet environment. The tub of the washing machine appliance is positioned between the basket, which may rotate at high speed, and a cabinet of the washing machine appliance, which is typically constructed of metal material. In typical washing machine appliances, clearances between the tub and the basket and/or cabinet may be relatively small. As a result of these small clearances, the tub may be impacted by the basket during operation of the washing machine appliance, such as when the basket is rotating at high speed, in particular when a load in the basket is unbalanced, and the tub may in turn impact the cabinet. Such impacts may damage the tub, in particular due to the relatively low momentum of the stationary tub as compared to the rotating basket and/or the relatively low strength of the plastic tub as compared to the metal cabinet.

Accordingly, a tub for a washing machine appliance which provides not only light weight and water resistance but also improved strength and durability would be desired.

BRIEF DESCRIPTION OF THE INVENTION

The present invention provides a reinforced tub for a washing machine that can prevent or resist damage from occurring during use. Aspects and advantages of the invention will be set forth in part in the following description, or may be apparent from the description, or may be learned through practice of the invention.

In one aspect, a washing machine appliance is provided. The washing machine appliance defines a vertical direction, a lateral direction and a transverse direction that are mutually perpendicular to one another. The washing machine appliance includes a cabinet defining an opening. A tub is non-rotatably mounted within the cabinet. The tub defines a central axis extending along an axial direction, a radial direction perpendicular to the central axis, and a circumferential direction extending around the central axis. The tub comprises a first material. A wash basket is rotatably mounted within the tub. The wash basket defines a wash chamber for receiving articles for washing. A reinforcement band encircles the tub generally along the circumferential direction. The reinforcement band comprises a second material having a greater strength than the first material of the tub.

In another aspect, a tub assembly for a washing machine appliance is provided. The tub assembly includes a tub. The tub defines a central axis extending along an axial direction, a radial direction perpendicular to the central axis, and a circumferential direction extending around the central axis. The tub comprises a first material. The tub assembly also includes a wash basket rotatably mounted within the tub. The wash basket defines a wash chamber for receiving articles for washing. A reinforcement band encircles the tub generally along the circumferential direction. The reinforcement band comprises a second material having a greater strength than the first material of the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
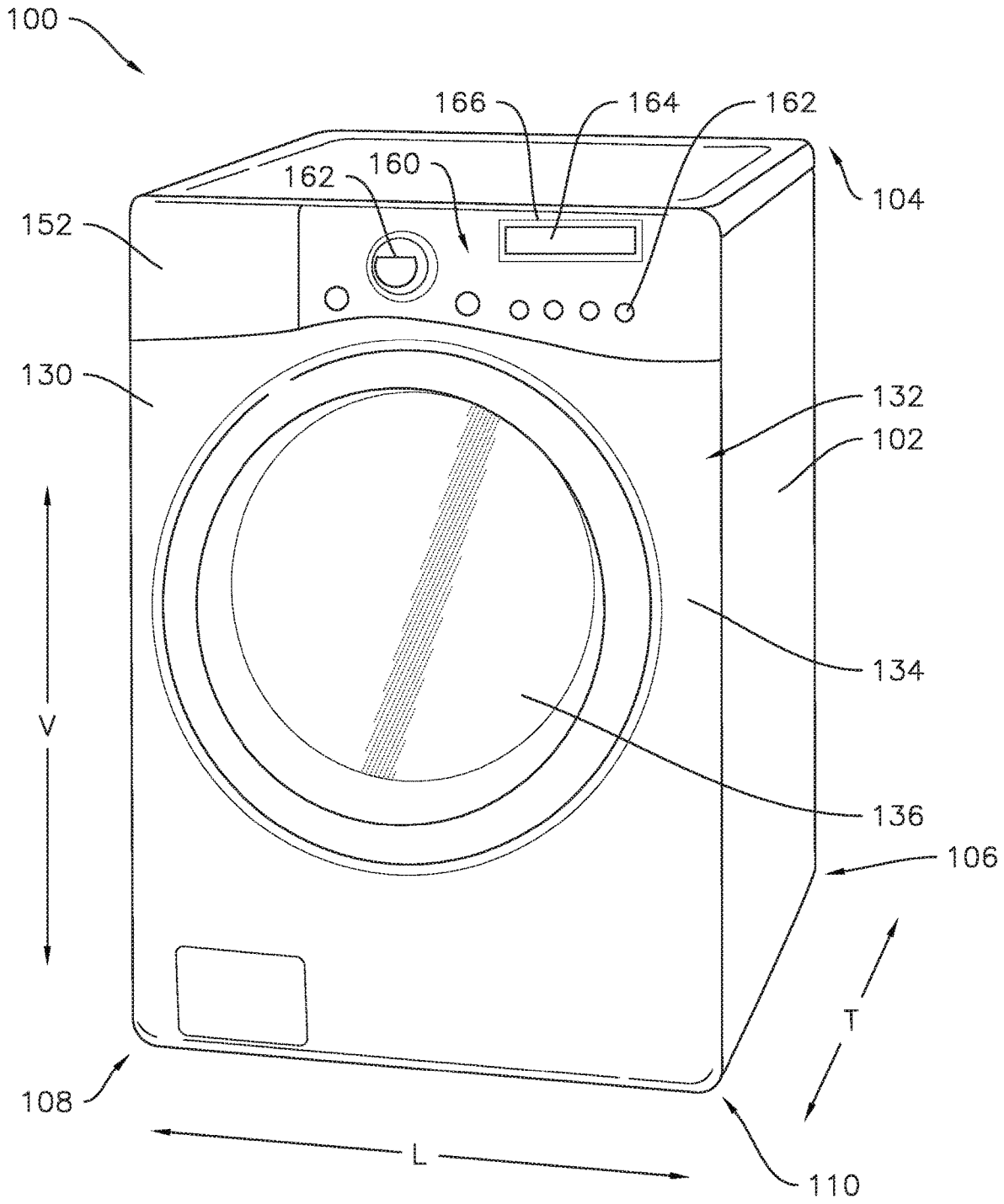
FIG. 1 provides a perspective view of an exemplary washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
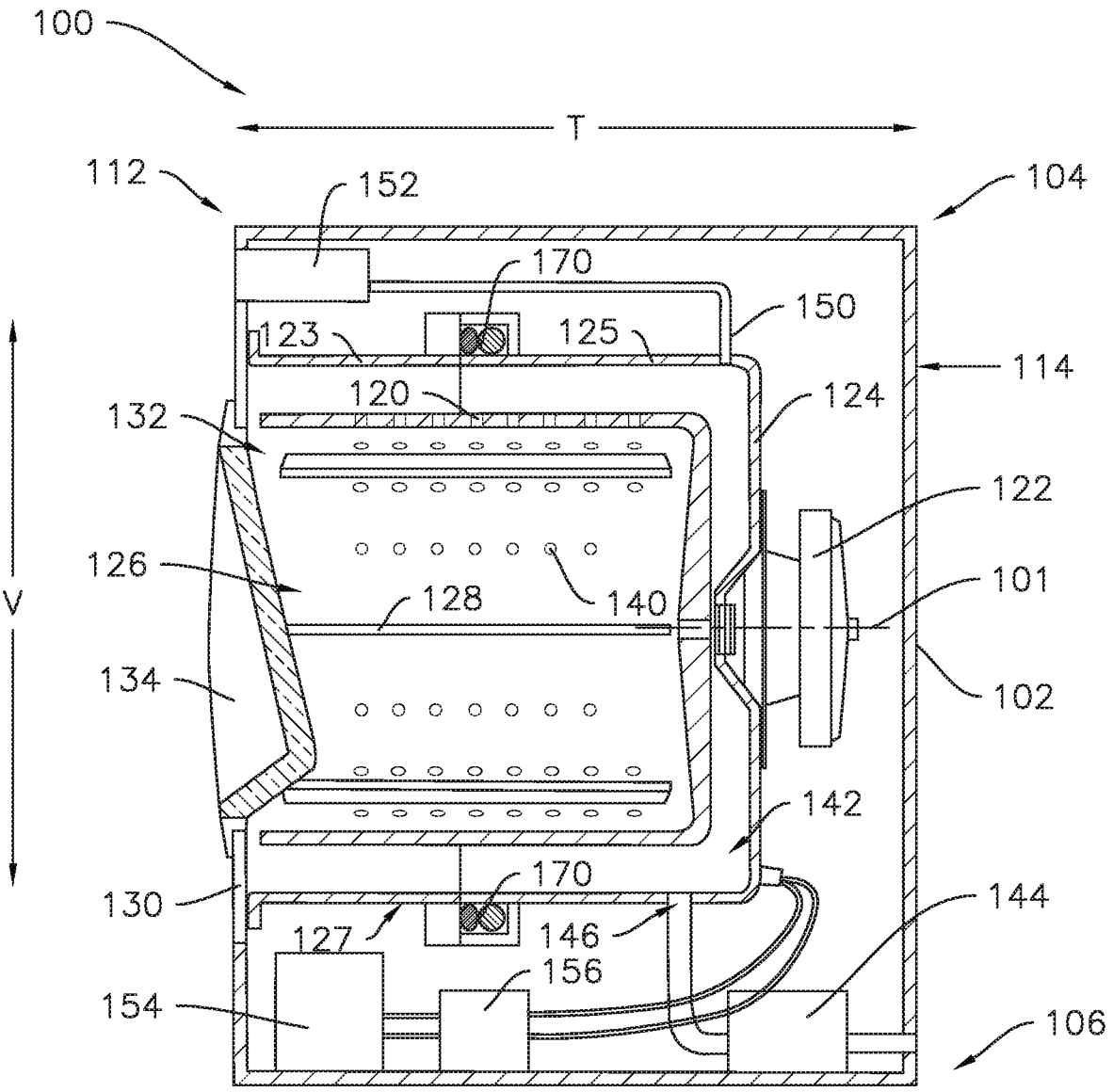
FIG. 2 provides a side cross-sectional view of the exemplary washing machine appliance of FIG. 1.

Referring now to the figures, FIG. 1 is a perspective view of an exemplary washing machine appliance 100 and FIG. 2 is a side cross-sectional view of the washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 (FIG. 2) and a rear 114 (FIG. 2) along the transverse direction T.

Referring to FIG. 2, a wash tub 124 is non-rotatably mounted within cabinet 102. As will be described in more detail below, a reinforcement band 170 may be provided around the wash tub 124. As may be seen in FIGS. 2 and 3, the wash tub 124 defines a central axis 101. The central axis 101 extends along an axial direction A (FIG. 3), and the tub 124 also defines a radial direction R perpendicular to the central axis 101, and a circumferential direction C extending around the central axis 101. In the example embodiment illustrated by FIG. 2, the central axis 101 may be oriented generally along or parallel to the transverse direction T of the washing machine appliance 100. Accordingly, the washing machine appliance 100 may be referred to as a horizontal axis washing machine.

Referring again to FIG. 2, a wash basket 120 is rotatably mounted within the tub 124 such that the wash basket 120 is rotatable about an axis of rotation, which generally coincides with central axis 101 of the tub 124. A motor 122, e.g., such as a pancake motor, is in mechanical communication with wash basket 120 to selectively rotate wash basket 120 (e.g., during an agitation or a rinse cycle of washing machine appliance 100). Wash basket 120 defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. The wash basket 120 and the tub 124 may collectively define at least a portion of a tub assembly for the washing machine appliance 100.

Wash basket 120 may define one or more agitator features that extend into wash chamber 126 to assist in agitation and cleaning of articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 within wash tub 124. More specifically, washing machine appliance 100 includes a door 134 that is positioned in front of opening 132 and is rotatably mounted to front panel 130. Door 134 is rotatable such that door 134 permits selective access to opening 132 by rotating between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 may be configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 152 may also be fluidly coupled to spout 150 to facilitate the complete and accurate dispensing of wash additive.

Additionally, a bulk reservoir 154 is disposed within cabinet 102. Bulk reservoir 154 is also configured for receipt of fluid additive for use during operation of washing machine appliance 100 (shown in FIG. 1). Bulk reservoir 154 is sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or microcontrol code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 150 and/or detergent drawer 152. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances such as washing machine appliance 200 illustrated in FIGS. 6 and 7 and described in further detail below.

In various embodiments, circumferential reinforcement band 170 may be provided encircling the wash tub 124. The tub 124 may comprise a first material and the reinforcement band 170 may comprise a second material having a greater strength than the first material of the tub 124. The greater strength of the first material may be determined with reference to impact strength, tensile strength, and/or shear strength, among other generally recognized measurements of strength. For example, the tub 124 may comprise a plastic material having an impact strength of about seven foot-pounds per inch (7 ft-lbs/in) or less, such as about two foot-pounds per inch (2 ft-lbs/in) or less, such as about one foot-pound per inch (1 ft-lbs/in) or less. Such plastic materials may have an ultimate tensile strength of about eighty megapascals (80 MPa) or less, such as about forty megapascals (40 MPa) or less, such as about 15 megapascals (15 MPa) or less.

In various embodiments, the reinforcement band 170 may comprise any suitable high-strength material such as metal, carbon fiber, or aramid. For example, the reinforcement band 170 may be composed entirely of carbon fibers or aramid fibers, e.g., reinforcement band 170 may be a braided cable or woven strap of one or both of such fibers. Reinforcement band 170 may also include carbon fibers and/or aramid fibers as reinforcing materials in a polymer substrate. Such carbon fiber materials may have an ultimate tensile strength of about sixteen hundred megapascals (1600 MPa) or more, such as about four thousand megapascals (4000 MPa) or more. Such aramid materials may have an ultimate tensile strength of about three thousand megapascals (3000 MPa) or more, such as about three thousand six hundred megapascals (3600 MPa) or more.

As another example, the second material may be a metal material having an impact strength of about ten foot-pounds per inch (10 ft-lbs/in) or more, such as about fifteen foot-pounds per inch (15 ft-lbs/in) or more, such as about fifty foot-pounds per inch (50 ft-lbs/in) or more. Similar to the carbon fiber and aramid materials described above, the metal material may be provided in any suitable form such as a solid or braided cable or a flat band, among others. Such metal materials may have an ultimate tensile strength of about four hundred megapascals (400 MPa) or more, such as about six hundred megapascals (600 MPa) or more, such as about eight hundred megapascals (800 MPa) or more, such as about nine hundred megapascals (900 MPa) or more.

In the foregoing examples, the plastic material may provide advantages such as water resistance and light weight, while the metal material may provide advantages such as increased overall strength of the tub 124. The strength of the first material and the second material may be measured according to any suitable standard such as ASTM standards or ISO standards. For example, where the greater strength is determined with reference to impact strength, the impact strength may be Izod impact strength measured according to, e.g., ASTM standard D256, or Charpy impact strength measured according to, e.g., ASTM standards E23, A370, and/or D6110.

Figure 4:
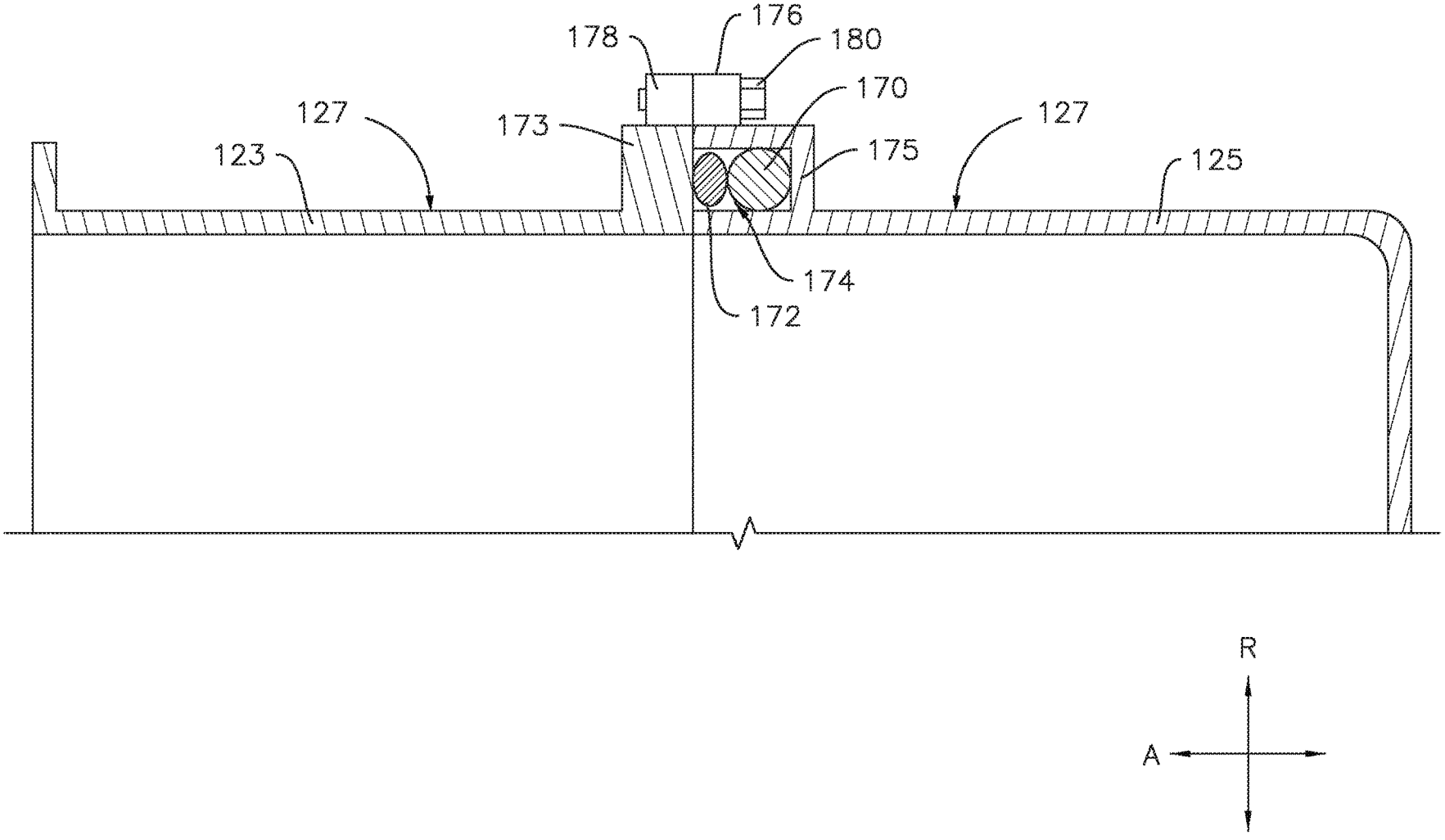
FIG. 4 provides a side cross-sectional view of a portion of a reinforced stationary outer tub for a washing machine appliance according to one or more exemplary embodiments of the present subject matter.
Figure 5:
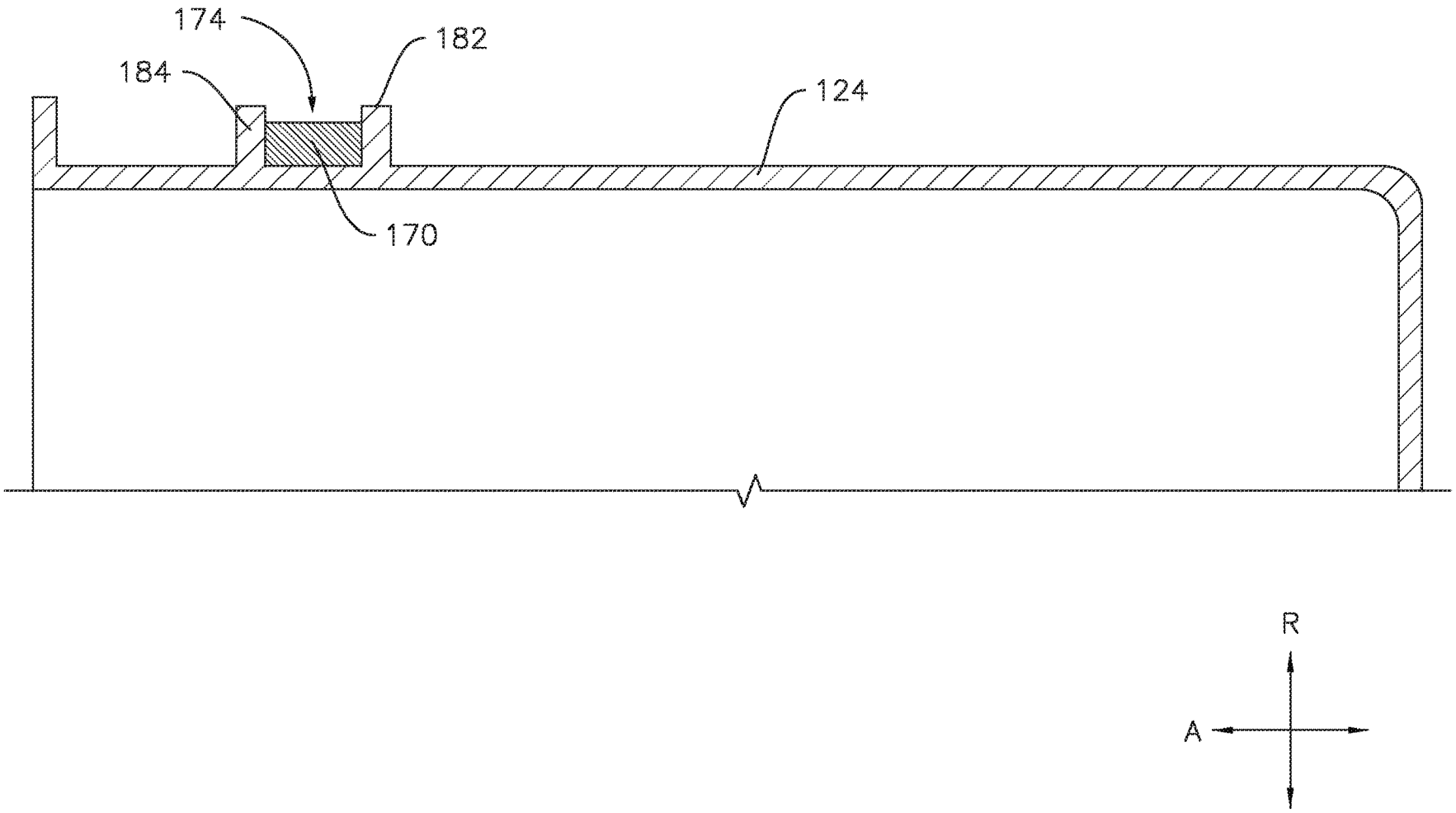
FIG. 5 provides a side cross-sectional view of a portion of a reinforced stationary outer tub for a washing machine appliance according to one or more additional exemplary embodiments of the present subject matter.
Figure 7:
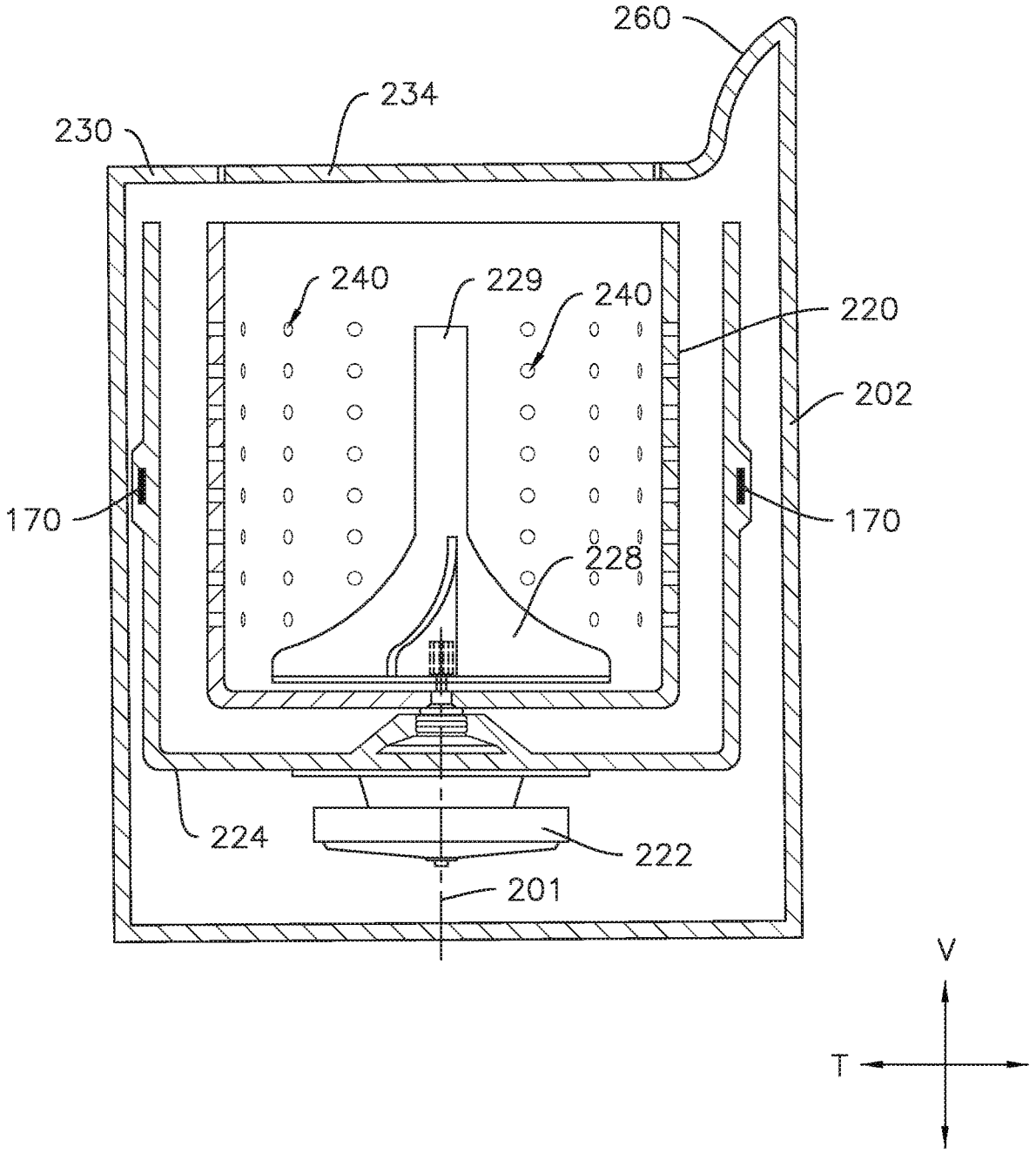
FIG. 7 provides a side cross-sectional view of the exemplary washing machine appliance of FIG. 6.

The reinforcement band 170 may be round (similar to a cable), braided wire, or flat (FIGS. 5 and 7). The reinforcement band 170 may define a round cross-sectional shape, e.g., the cable or braided wire embodiments, or may define a rectangular cross-sectional shape, e.g., may be flat. The reinforcement band 170 is a closed band which completely surrounds the wash tub 124 generally along the circumferential direction. As used herein, terms of approximation such as "about," "generally," or "substantially," are to be understood as including within ten percent greater or less than the stated amount. Further, as used herein, such terms in the context of an angle or direction include within ten degrees greater or less than the stated angle or direction. The ends of the band 170 may be joined together to provide a closed band by welding, crimping, or any other suitable method of joining. In some embodiments, the reinforcement band 170 may be inserted into a slot 174 (FIGS. 3-5) in the wash tub 124. In other embodiments, such as illustrated for example in FIG. 7, the reinforcement band 170 may be embedded in the wash tub 124. In further embodiments, the reinforcement band 170 may simply be strapped to the outside of the wash tub 124, e.g., on and around an exterior surface 127 of the wash tub 124. It is to be understood that the exterior surface 127 of the tub 124 is opposite an interior surface of the tub 124 and the interior surface of the tub 124 faces the basket 120. Additionally, in some embodiments, more than one reinforcement band 170 may be provided.

Figure 3:
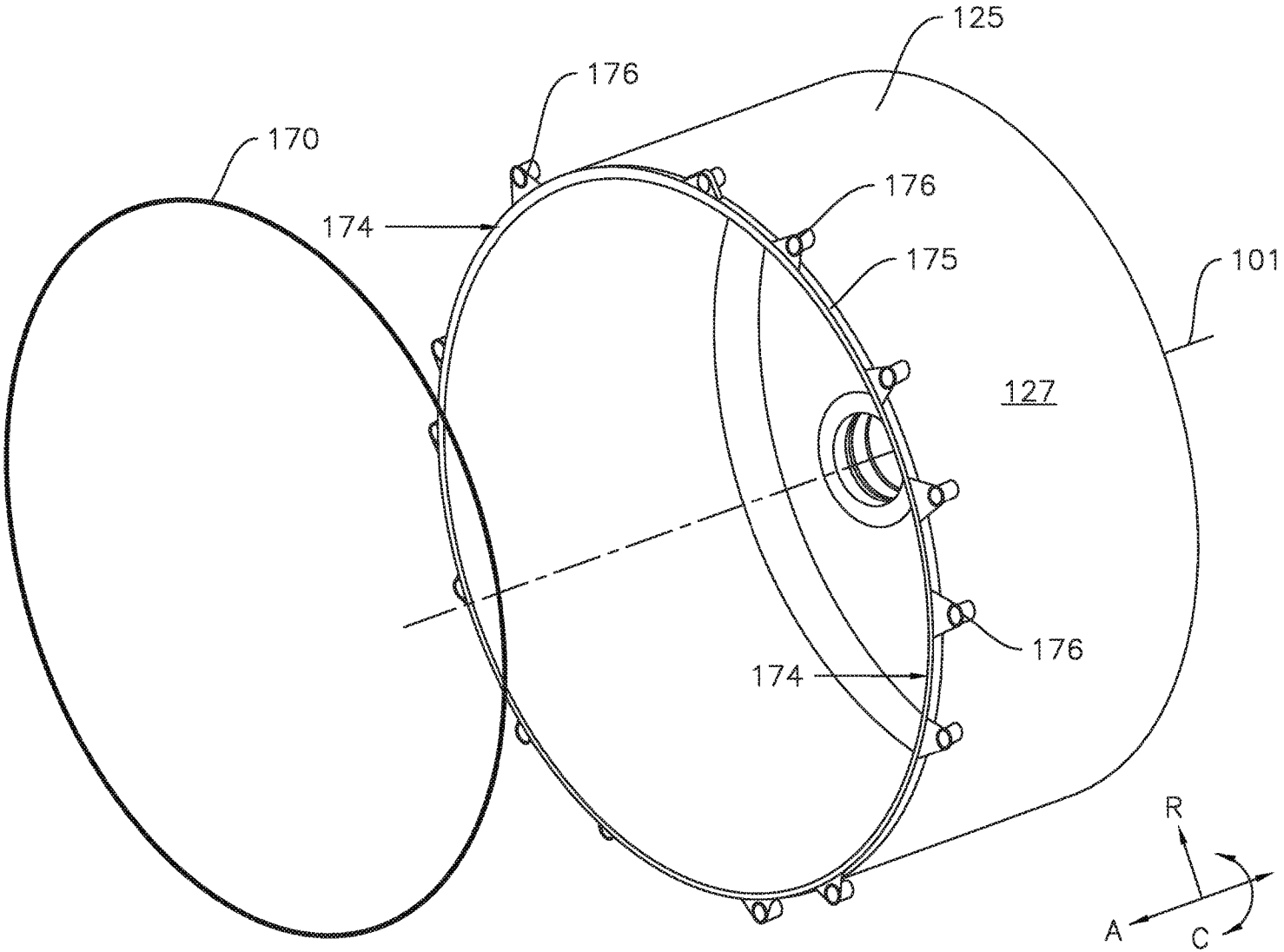
FIG. 3 provides a perspective view of a portion of a wash tub for a washing machine appliance according to one or more exemplary embodiments of the present subject matter.

In some embodiments, the wash tub 124 may comprise a plurality of sections, such as two halves, such as the front half 123 and rear half 125 illustrated in FIG. 2. As illustrated in FIG. 2, the rear half 125 may be positioned distal from the opening 132 along the transverse direction T and the front half 123 may be positioned proximate the opening 132 along the transverse direction T. In some such embodiments, for example as shown in FIGS. 3 and 4, the reinforcement band 170 may be received in a slot 174. The slot 174 may be oriented along the axial direction A for receipt of the reinforcement band 170. The slot 174 may be defined in either the front half 123 of the wash tub 124, or, as illustrated for example in FIGS. 3 and 4, in the rear half 125 of wash tub 124. FIG. 3 provides an exploded view of the rear half 125 of wash tub 124 and reinforcement band 170. As shown in FIG. 3, the rear half 125 of the wash tub 124 may be provided with a plurality of bosses 176 arranged circumferentially around the rear half 125, such as along a peripheral rim or flange 175 positioned at a front edge of the rear half 125. As shown in FIG. 4, fasteners 180, which may be, for example, threaded fasteners, may be provided to fasten rear bosses 176 of the rear half 125 to front bosses 178 positioned on the front half 123 of the wash tub 124. One or both of the bosses 176, 178 may be provided with mating threads to engage threads of the threaded fasteners 180. For example, threaded fasteners 180 may be externally threaded and one or both of bosses 176, 178 may include internal threads to threadedly engage the fasteners 180.

FIG. 4 provides a partial section view of the wash tub 124 as illustrated in FIGS. 2 and 3. As best seen in FIG. 4, the front half 123 may include a flange 173 corresponding to the flange 175 of the rear half 125. One or the other of the flanges 173, 175 may include a slot 174 for receipt of the reinforcement band 170, e.g., in rear flange 175, as illustrated in FIG. 4. Additionally, a gasket or seal 172 may be received in slot 174. For example, as illustrated in FIG. 4, the seal 172 may be positioned between the reinforcement band 170 and the corresponding flange 173. The seal 172 may be formed of a resilient material, such as rubber, and may comprise an annular shape, such as an O-ring seal. The slot 174 may be sized and configured such that the seal 172 is compressed or biased between the reinforcement band 170 and the corresponding flange 173. It should be understood that in other embodiments, the slot 174 may be formed in front flange 173 and in such embodiments the rear flange 175 would comprise the corresponding flange as described above.

In some embodiments, such as illustrated for example in FIG. 5, the slot 174 may be oriented along the radial direction R for receipt of the reinforcement band 170. For example, the tub 124 may include a first rib 182 extending away from exterior surface 127 generally along the radial direction R and a second rib 184 generally parallel to the first rib 182. The first rib 182 and the second rib 184 may be spaced apart along the axial direction A to define a radially-oriented slot 174 therebetween.

As noted above, FIGS. 6 and 7 illustrate example embodiments of reinforcement band 170 provided in a vertical axis washing machine 200. In particular, in the example embodiment illustrated by FIGS. 6 and 7, the central axis 201 of the wash tub 224 is oriented generally along or parallel to the vertical direction V of the washing machine appliance 200. Accordingly, the washing machine appliance 200 may be referred to as a vertical axis washing machine.

Figure 6:
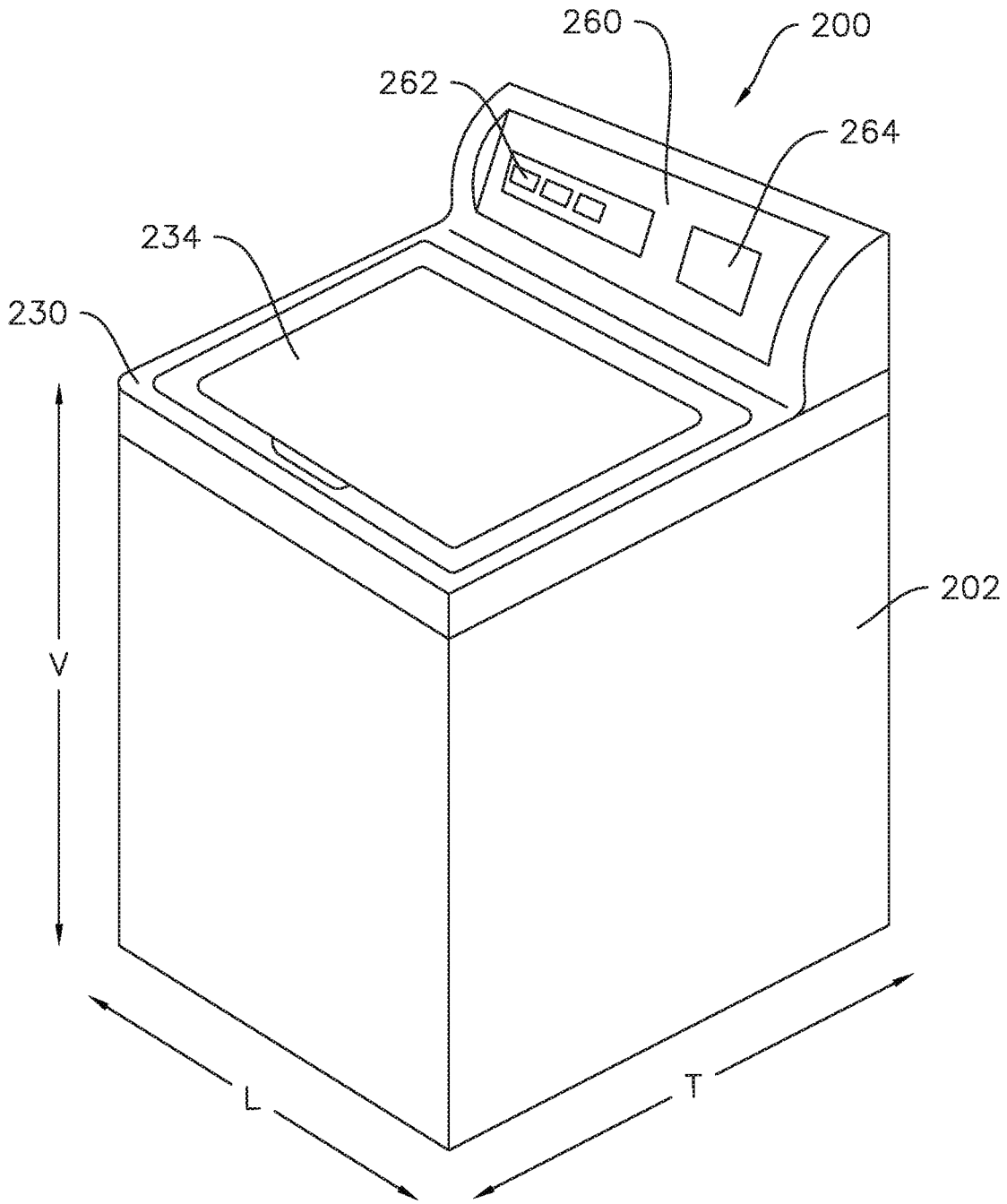
FIG. 6 provides a perspective view of another exemplary washing machine appliance according to one or more exemplary embodiments of the present subject matter.

The washing machine appliance 200 may be configured generally similarly to the washing machine appliance 100 described above. For example, as seen in FIG. 6, the washing machine appliance 200 may generally define a vertical direction V, a lateral direction L, and a transverse direction T, each of which is mutually perpendicular. Washing machine appliance 200 may include a cabinet 202 with a door or lid 234 provided in a top panel 230 of the cabinet 202. Additionally, a control panel 260 may be provided on the cabinet 202, and may include a plurality of input selectors 262 and a display 264.

As shown in FIG. 7, the washing machine appliance 200 may include a tub 224 non-rotatably mounted within the cabinet 202 and a wash basket 220 rotatably mounted within the tub 224. A motor 222, e.g., such as a pancake motor, is in mechanical communication with wash basket 220 to selectively rotate wash basket 220 (e.g., during an agitation or a rinse cycle of washing machine appliance 200). Wash basket 220 may define one or more agitator features to assist in agitation and cleaning of articles disposed within wash basket 220 during operation of washing machine appliance 200. For example, as illustrated in FIG. 7, a plurality of ribs 228 extends within basket 220 and are circumferentially disposed around a shaft 229. Wash basket 220 may also define a plurality of perforations 240 in order to facilitate fluid communication between an interior of basket 220 and wash tub 224. As noted above, the reinforcement band 170 of FIG. 7 may be embedded in the tub 224. For example, the wash tub 224 may comprise a plastic material and the reinforcement band 170 may be molded into the plastic of the wash tub 224.

In accordance with the present disclosure, a strength of the tub assembly may be enhanced via the reinforcement band 170. Moreover, such reinforcement may be provided without altering the structure or geometry of the rotatable basket, e.g., 120 or 220. Advantageously, positioning the reinforcement band 170 on the outer, non-rotatable tub 124 or 224 promotes free fluid communication between the basket and the tub. For example, perforations of the basket are not obstructed. Additionally, positioning the reinforcement band 170 on the outer, non-rotatable tub reduces sudsing and avoids undesirable air entrainment into the wash fluid during operation of the washing machine appliance 100 or 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction and a transverse direction that are mutually perpendicular to one another, the washing machine appliance comprising:

a cabinet defining an opening;

a tub non-rotatably mounted within the cabinet, the tub defining a central axis extending along an axial direction, a radial direction perpendicular to the central axis, and a circumferential direction extending around the central axis, the tub comprising a first material;

a wash basket rotatably mounted within the tub, the wash basket defining a wash chamber for receiving articles for washing; and a reinforcement band encircling the tub generally along the circumferential direction, the reinforcement band comprising a second material having a greater strength than the first material of the tub.

2. The washing machine appliance of claim 1, wherein the reinforcement band is positioned on an exterior surface of the tub.

3. The washing machine appliance of claim 1, wherein the tub defines a slot oriented along the axial direction for receipt of the reinforcement band.

4. The washing machine appliance of claim 1, wherein the tub defines a slot oriented along the radial direction for receipt of the reinforcement band.

5. The washing machine appliance of claim 1, wherein the central axis of the tub is oriented along the transverse direction, the tub further comprises a rear half distal from the opening along the transverse direction and a front half proximate the opening along the transverse direction, and the rear portion of the tub defines a slot for receipt of the reinforcement band.

6. The washing machine appliance of claim 1, wherein the reinforcement band is embedded within the tub.

7. The washing machine appliance of claim 1, wherein the second material of the reinforcement band has a greater tensile strength than the first material of the tub.

8. The washing machine appliance of claim 1, wherein the second material of the reinforcement band has a greater impact strength than the first material of the tub.

9. The washing machine appliance of claim 1, wherein the reinforcement band comprises a round cross-sectional shape.

10. The washing machine appliance of claim 1, wherein the reinforcement band comprises a rectangular cross-sectional shape.

11. A tub assembly for a washing machine appliance, the tub assembly comprising:

a tub defining a central axis extending along an axial direction, a radial direction perpendicular to the central axis, and a circumferential direction extending around the central axis, the outer tub comprising a first material;

a wash basket rotatably mounted within the tub, the wash basket defining a wash chamber for receiving articles for washing; and a reinforcement band encircling the tub generally along the circumferential direction, the reinforcement band comprising a second material having a greater strength than the first material of the tub.

12. The tub assembly of claim 11, wherein the reinforcement band is positioned on an exterior surface of the tub.

13. The tub assembly of claim 11, wherein the tub defines a slot oriented along the axial direction for receipt of the reinforcement band.

14. The tub assembly of claim 11, wherein the tub defines a slot oriented along the radial direction for receipt of the reinforcement band.

15. The tub assembly of claim 11, wherein the tub further comprises a rear half distal from the opening along the axial direction and a front half proximate the opening along the axial direction, and the rear portion of the tub defines a slot for receipt of the reinforcement band.

16. The tub assembly of claim 11, wherein the reinforcement band is embedded within the tub.

17. The tub assembly of claim 11, wherein the second material of the reinforcement band has a greater tensile strength than the first material of the tub.

18. The tub assembly of claim 11, wherein the second material of the reinforcement band has a greater impact strength than the first material of the tub.

19. The tub assembly of claim 11, wherein the reinforcement band comprises a round cross-sectional shape.

20. The tub assembly of claim 11, wherein the reinforcement band comprises a rectangular cross-sectional shape.

* * * * *